US007841269B1

(12) United States Patent
Jacobs

(10) Patent No.: US 7,841,269 B1
(45) Date of Patent: Nov. 30, 2010

(54) DEPLOYABLE DEFENSE BARRIER FOR MOTOR VEHICLES

(76) Inventor: Keith Jacobs, 34 Ridgeway, Saline, MI (US) 48176

( * ) Notice: Subject to any disclaimer, the term of this patent is extended or adjusted under 35 U.S.C. 154(b) by 524 days.

(21) Appl. No.: 11/925,652

(22) Filed: Oct. 26, 2007

(51) Int. Cl.
*F41H 7/02* (2006.01)

(52) U.S. Cl. ..... 89/36.08; 89/36.01; 296/187.07

(58) Field of Classification Search ..... 89/36.07–36.09, 89/36.11–36.14; 296/187.07
See application file for complete search history.

(56) References Cited

U.S. PATENT DOCUMENTS

| | | | | |
|---|---|---|---|---|
| 2,871,763 | A | 2/1959 | Blomquist | |
| 3,478,643 | A | 11/1969 | Forsyth et al. | |
| 3,590,685 | A | 7/1971 | Lane | |
| 3,983,832 | A | 10/1976 | Kinder | |
| 4,530,519 | A | 7/1985 | Marshall | |
| 5,074,611 | A * | 12/1991 | Newkirk | 296/146.6 |
| 5,370,035 | A | 12/1994 | Madden, Jr. | |
| 5,576,508 | A | 11/1996 | Korpi | |
| 6,027,158 | A * | 2/2000 | Yang | 296/146.6 |
| 6,327,954 | B1 * | 12/2001 | Medlin | 89/36.08 |
| 6,425,311 | B1 * | 7/2002 | Caron | 89/36.14 |
| 7,007,585 | B2 * | 3/2006 | Gonzalez | 89/36.04 |
| 7,152,517 | B1 | 12/2006 | Ivey | |
| 7,533,600 | B2 * | 5/2009 | Marqueling | 89/36.09 |
| 2009/0044694 | A1 * | 2/2009 | Allor et al. | 89/36.08 |
| 2009/0120273 | A1 * | 5/2009 | Eckdahl et al. | 89/36.08 |
| 2009/0241318 | A1 * | 10/2009 | Howard | 29/428 |

FOREIGN PATENT DOCUMENTS

| | | |
|---|---|---|
| EP | 658738 | 6/1995 |
| JP | 200239589 | 8/2004 |

* cited by examiner

*Primary Examiner*—J. W Eldred
*Assistant Examiner*—Gabriel J Klein
(74) *Attorney, Agent, or Firm*—Michael I Kroll

(57) ABSTRACT

An hydraulically deployable vehicle defense shield having a plurality of coplanar ballistic resistant elements in a single defense barrier that provides protection from the side to the vehicles engine and tires when non-deployed and when deployed provides cover for personnel exiting the vehicle and during a firefight. The defense barrier may also be deployed for the purpose of ramming another vehicle.

14 Claims, 15 Drawing Sheets

DEPLOYABLE DEFENSE BARRIER FOR MOTOR VEHICLES

BACKGROUND OF THE INVENTION

1. Field of the Invention

The present invention relates generally to motor vehicles and, more specifically, to a motor vehicle defense barrier that is hydraulically deployable from within said vehicle in angular fashion from a substantially vehicle parallel position to a vehicle transverse position or any angle therebetween.

The defense barrier has an audible alarm to warn persons to move from the vehicle and deployable defense barrier path actuated by a sensor for sensing the presence of people in the vehicle or shield path thereby actuating the audible alarm and further provides exteriorly positioned lights of a flashing or warning nature.

When deployed a manually pivotally movable shelf or table is provided on the interior barrier side serving for the placement of articles thereon with the instant invention further providing an optional marquee serving as a sun shield and/or protective element from inclement weather.

Additionally provided is a plurality of defense barriers that are deployable from a plurality of vehicle engaging positions.

Uses of the defensive barrier includes obliquely deploying at least one of the defense barriers that can be used as a ram to disable or halt another vehicle and as a defensive element from small arms or rifle fire so that the vehicle occupants can tactically exit said vehicle and use said defense barrier as a shield when confronting an aggressor.

The defense barrier is comprised of a pair of coplanar members where one is both transparent and linearly extendible to augment the shield surface area with the other having a slot which is normally obstructed by the transparent shield member that when moved provides for the slot to serve as a port for firearm use.

The present invention further provides that the defense barrier of the present invention can be used on any motorized vehicle and may find application for military vehicles as well.

2. Description of the Prior Art

There are other protective devices designed for vehicles. Typical of these is U.S. Pat. No. 2,871,763 issued to Blomquist on Feb. 3, 1959.

Another patent was issued to Forsyth, et al on Nov. 18, 1969 as U.S. Pat. No. 3,478,643. Yet another U.S. Pat. No. 3,590,685 was issued to Lane on Jul. 6, 1971 and still yet another was issued on Oct. 5, 1976 to Kinder as U.S. Pat. No. 3,983,832.

Another patent was issued to Marshall on Jul. 23, 1985 as U.S. Pat. No. 4,530,519. Yet another U.S. Pat. No. 5,370,035 was issued to Madden, Jr. on Dec. 6, 1994. Another was issued to Korpi on Nov. 19, 1996 as U.S. Pat. No. 5,576,508 and still yet another was issued on Dec. 30, 1997 to Madden, Jr. as U.S. Pat. No. 5,730,316.

Another patent was issued to Ivey on Dec. 26, 2006 as U.S. Pat. No. 7,152,517. Yet another U.S. Patent No. EP 0 658 738 was issued to Madden, Jr. on Jun. 21, 1995. Another was issued to Higuchi on Aug. 26, 2004 as Japan Patent No. JP2004239589.

U.S. Pat. No. 2,871,763

Inventor: Albert E. Blomquist

Issued: Feb. 3, 1959

A vehicle comprising a body, carrying means for said body, and protective armor means secured to said body along a margin of said body, said protective armor means being secured to said body by substantially horizontally pivoted hinge means for pivotal movement about said hinge means between upstanding position and laterally disposed position extending outwardly from said body, and means for maintaining said protective armor means in each of said positions, said protective armor means comprising a trough when said protective armor means is in said laterally disposed position which is disposed alongside said body and is adapted to contain a friable aggregate material for providing additional armor effective for protecting said body.

U.S. Pat. No. 3,478,643

Inventor: Robert W. Forsyth

Issued: Nov. 18, 1969

Ballastic shielding apparatus comprising:

a self-propelled vehicle having a body of predetermined configuration; at least one shield movably carried on said body adapted to be advanced outwardly from said body so as to define a personnel protection area between said shield and said body;

means carried on said body and operably coupled to said shield for selectively moving said shield away from and back to said body; and said moving means includes an electro-hydraulic actuator means having a switch means exposed exteriorly of said body in communication with the inside surface of said shield when said shield is in its fully retracted position against said body.

U.S. Pat. No. 3,590,685

Inventor: Frank B. Lane

Issued: Jul. 6, 1971

A mobile revetment of vehicular form. Armor plate is normally stored in a stowed, retracted position on a low slung wheeled frame. Self-contained power means deploys the armor and controls its return to retracted position. The device has connections on its ends so that multiple units may be towed as a train for disposing in protective array. In a stowed condition units may be stacked one upon another for ease of transportation.

U.S. Pat. No. 3,983,832

Inventor: Floyd A. Kinder

Issued: Oct. 5, 1976

An amphibious vehicle is provided with pivoted plates on either side for ement between an extended position approximately horizontal and a "folded" position approximately vertical with respect to the normal position of the vehicle. A third plate may also be attached beneath and parallel to the bottom of the vehicle. These plates are so shaped that in the extended position they serve as planing skis and are fabricated from a material which will afford armor protection to the vehicle when the plates are in the folded or retracted position.

U.S. Pat. No. 4,530,519

Inventor: Donald J. Marshall

Issued: Jul. 23, 1985

A system for protecting the doors and part of the side panels of a stationary vehicle includes a sheet-like shield that is selectively power actuated from a recessed position within the body of the vehicle to an extended position to protect the vehicle's door panels and part of the side panels. The shield, formed of flexible, yet rigid, material, is engaged by a motor-driven spindle mounted within a cylindrical housing. Projecting members, affixed to the inside of the shield, include end portions that are slidably housed within tracks secured to the door frame to provide paths extending from the cylindrical housing (located within the vehicle's rocker panel) so that, upon activating of the motor, the shield is unwound from the spindle and guided to a side covering position.

U.S. Pat. No. 5,370,035

Inventor: James R. Madden, Jr.

Issued: Dec. 6, 1994

Removable bulletproof apparatus for the back of the front seat of a vehicle includes a transparent panel which is secured to or disposed adjacent to the front seat of the vehicle and a flexible curtain is secured to the bottom portion of the transparent panel. Both the transparent panel and the curtain are bulletproof. The curtain may be easily installed and easily removed from the transparent panel. The curtain is made of layers of fibrous material, such as woven cloth, preferably of an aramid fiber, such as a "Kevlar" cloth, or "SPECTRA SHIELD" material. Wing portions may be secured to the curtain and extended to door posts to provide additional protection for the occupants of the front seat from bullets fired from the rear of the vehicle or from rearwardly of the front door.

U.S. Pat. No. 5,576,508

Inventor: John G. Korpi

Issued: Nov. 19, 1996

A vehicle's armor assembly has a track on the vehicle's exterior, a pair of arriers translatable along the track, and a rotatable threaded rod for effecting relative axial motion of the carriers along the track. Arms of unequal length pivot on the carriers, the longer arm having a more elongate slot than does the shorter arm. A pin closely fits the slots and connects the arms at their intersection so that the arms are translatable and rotatable relative to the pin. The armor assembly has an armor plate or like element to which is fixed a pair of hinge elements, and the hinge elements have rotational connections to the arms. The carriers, arms and hinges act in concert to move the armor element from a retracted position to a deployed position. The retracted position is near the exterior zone and is parallel thereto, whereas the deployed position is remote from the exterior zone and oblique thereto.

U.S. Pat. No. 5,703,316

Inventor: James R. Madden, Jr.

Issued: Dec. 30, 1997

Bullet resistant curtain apparatus protects the rear of a vehicle. The curtain apparatus includes a curtain secured to the trunk lid of the vehicle and is deployed when the trunk lid is opened. The curtain apparatus includes a flexible curtain made of a plurality of bullet resistant cloth layers. The curtain folds as the trunk closes. A second embodiment includes a movable base with posts to which the curtain may be secured to comprise a portable shield. The base includes wheels for moving the portable shield. The curtain is removably secured to the trunk lid and is thus easily converted into the movable, portable shield.

U.S. Pat. No. 7,152,517

Inventor: D C Ivey

Issued: Dec. 26, 2006

A defensive shield for a ship has a support arm, pivotally mounted to a ship, and a shield pivotally mounted to one end of the support arm. The support arm is movable between a retracted position and a plurality of deployed defensive positions. In the deployed positions, the shield is outwardly spaced from the ship and angled to defend against attacks, such as aerial attacks and underwater attacks.

European Patent Application Number EP 0658738

Inventor: James R. Madden, Jr.

Published: Jun. 21, 1995

Removable bullet-resisting apparatus for a vehicle includes a transparent panel which is secured to or disposed adjacent to a vehicle window and a flexible curtain is secured to a bracket to which the bottom portion of the transparent panel is secured. Both the transparent panel and the curtain are bullet-resisting. Both the panel and the curtain are easily installed and easily removed from their common bracket and from the vehicle. Depending on the particular design or structure of a vehicle in which the apparatus is installed, various top bracket structures may be used. The curtain is made of layers of cloth, which may be woven or nonwoven material. In one embodiment, as for use in law enforcement vehicles, the curtain includes a bottom flap or portion that may be pivoted down when the door is opened to provide an officer with essentially a full length bullet-resisting shield. The full length shield includes both the transparent panel and the curtain and its flap. A similar curtain and transparent panel may be secured to and behind the front seat to protect the occupants of the front seat from bullets fired from the rear of the vehicle or from rearwardly of the front door.

Japan Patent Number JP2004239589

Inventor: Kuzuyuki Higuchi

Issued: Aug. 26, 2004

PROBLEM TO BE SOLVED

To provide safety of a policeman, a Self-Defense official, a guard, or the like carrying out patrol, transportation of valuables, or the like on a two wheeler.

SOLUTION

The shield with the windscreen function is normally attached to a vehicle body as a windscreen device of a two wheeler front part, and it is removed from the vehicle body and used as a shield to carry out self-defense and suppression in an emergency situation. The material is a lightweight material such as glass or plastic having bulletproof and stab-proof functions, or a similar material.

While these ballistic shields may be suitable for the purposes for which they were designed, they would not be as suitable for the purposes of the present invention, as hereinafter described.

SUMMARY OF THE PRESENT INVENTION

A primary object of the present invention is to provide a motor vehicle with a deployable defense barrier.

Another object of the present invention is to provide a motor vehicle defense barrier that is hydraulically deployable.

Yet another object of the present invention is to provide a motor vehicle defense barrier that is angularly deployable from the body of the vehicle.

Still yet another object of the present invention is to provide a motor vehicle defense barrier wherein said defense barrier is angularly deployable from a substantially vehicle parallel position to a vehicle transverse position or any angle therebetween.

An additional object of the present invention is to provide a motor vehicle with a defense barrier that is controllably deployable from the interior of the vehicle.

A further another object of the present invention is to provide a motor vehicle defense barrier having an audible alarm to warn persons to move from the vehicle and deployable defense barrier path.

A yet further object of the present invention is to provide a sensor for sensing the presence of people in the vehicle or shield path thereby actuating the audible alarm.

A still yet further object of the present invention is to provide a motor vehicle defense barrier with exteriorly positioned lights of a flashing or warning nature.

Another object of the present invention is to provide a motor vehicle defense barrier that when deployed provides a pivotally movable shelf or table on the interior barrier side serving for the placement of articles thereon.

Yet another object of the present invention is to provide an optional marquee for said deployable defense barrier as a sun shield and/or protective element from inclement weather.

Still yet another object of the present invention is to provide a motor vehicle with a plurality of defense barriers that are deployable from a plurality of vehicle engaging positions.

An additional object of the present invention is to provide a motor vehicle defense barrier that can be deployed obliquely whereby said defense barrier can be used as a ram against another vehicle.

A further object of the present invention is to provide a motor vehicle defense barrier forming a ballistics defense shield.

A yet further object of the present invention is to provide a motor vehicle with extendible defense barrier forming a shield whereby the vehicle occupants can tactically exit said vehicle and use said defense barrier as a shield when confronting an aggressor.

A still yet further object of the present invention is to provide a motor vehicle defense barrier wherein said defense barrier is comprised of a pair of coplanar members where one is linearly extendible to augment the shield surface area.

Another object of the present invention is to provide a motor vehicle defense barrier wherein one of the pair of coplanar shield members is transparent for viewing a hostile situation while affording a protective shield.

Yet another object of the present invention is to provide one of the pair of coplanar shield members with a slot which is normally obstructed by the transparent shield member that is movable whereby the slot serves as a portal for firearm use.

Additional objects of the present invention will appear as the description proceeds.

The present invention overcomes the shortcomings of the prior art by providing a motor vehicle defense barrier that is hydraulically deployable from within the vehicle in angular fashion having defense barrier exterior lights and sensor for sensing the presence of a person and audible to warn persons to move from the vehicle and deployable defense barrier path.

The defense barrier can be used to disable another vehicle by angularly deploying the barrier and ramming the other vehicle without damaging the defense barrier enabled vehicle and as a defensive element from small arms or rifle fire so that the vehicle occupants can tactically exit said vehicle and use said defense barrier as a shield.

The defense barrier is comprised of a pair of coplanar members where one is both transparent and linearly extendible to augment the shield surface area with the other having a slot which is normally obstructed by the transparent shield member that when moved provides for the slot to serve as a port for firearms use. When deployed a manually pivotally movable shelf or table is provided on the interior barrier side serving for the placement of articles thereon with the invention further providing an optional marquee serving as a sun shield and/or protective element from inclement weather.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
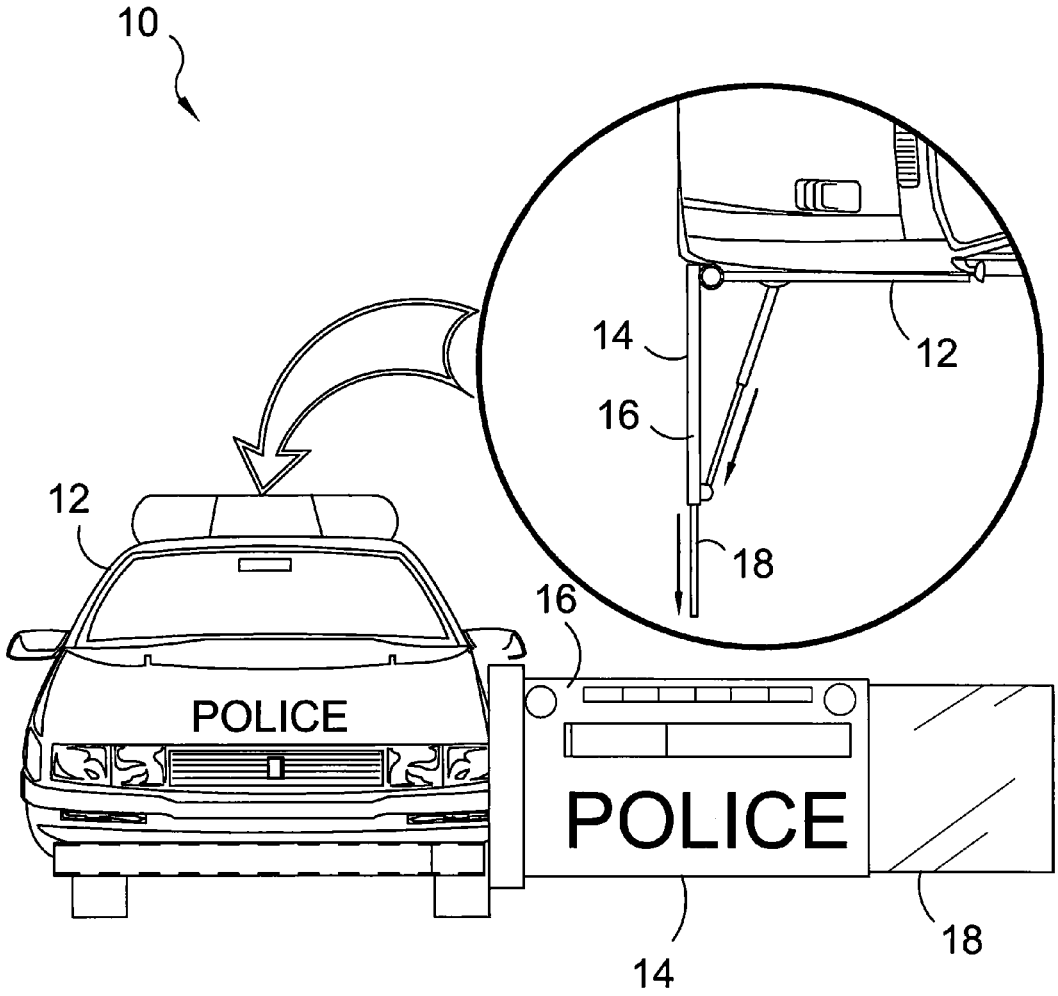
FIG. 1 is an illustrative view of the present invention in use.

Turning now descriptively to the drawings, in which similar reference characters denote similar elements throughout the several views, the figures illustrate the Deployable Vehicle Defense Shield of the present invention. With regard to the reference numerals used, the following numbering is used throughout the various drawing figures.

Deployable Vehicle Defense Shield of the present invention

12 vehicle
13 door of 12
14 defense barrier
16 armored shield
18 transparent ballistic shield
19 Lexan
20 halogen light
22 flashing light strip
24 track mount
26 slidable track
27 user control unit
28 hydraulic piston
30 hydraulic cylinder
32 shaft of 28
34 pivot hinge
36 first end of 30
38 second end of 30
40 first end of 32
42 second end of 32
44 cylinder slide mount
46 first end of 24
48 second end of 24
50 first end of 16
52 second end of 16
56 ballistic shield housing
58 shaft pivot mount
60 front armor plate
61 slot
62 rear armor plate
64 viewing and firing port
66 small arms fire
68 magnum pistol fire
70 medium rifle fire
72 high velocity armor piercing rifle fire
74 radar identification and warning system
76 radar
78 radar sensor
80 audible alarm
82 pedestrian
84 target vehicle
86 front defense barrier
88 rear defense barrier
90 flip down table top
92 hinge of 90
94 thumbscrew of 90
96 locking port
98 marquee screen

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Shown is a frontal illustrative view depicting the present invention as being a vehicle 12 mounted deployable defensive barrier 10 being field expedient and deployable by personnel to provide ballistic defense or a hardened extension of said vehicle blocking or ramming a target vehicle. The primary components of the present invention 10 comprises a pivotable defense barrier 14 with an armored plate 16 and an integral coplanar bulletproof transparent shield 18 that selectively extends therefrom.

Figure 2:
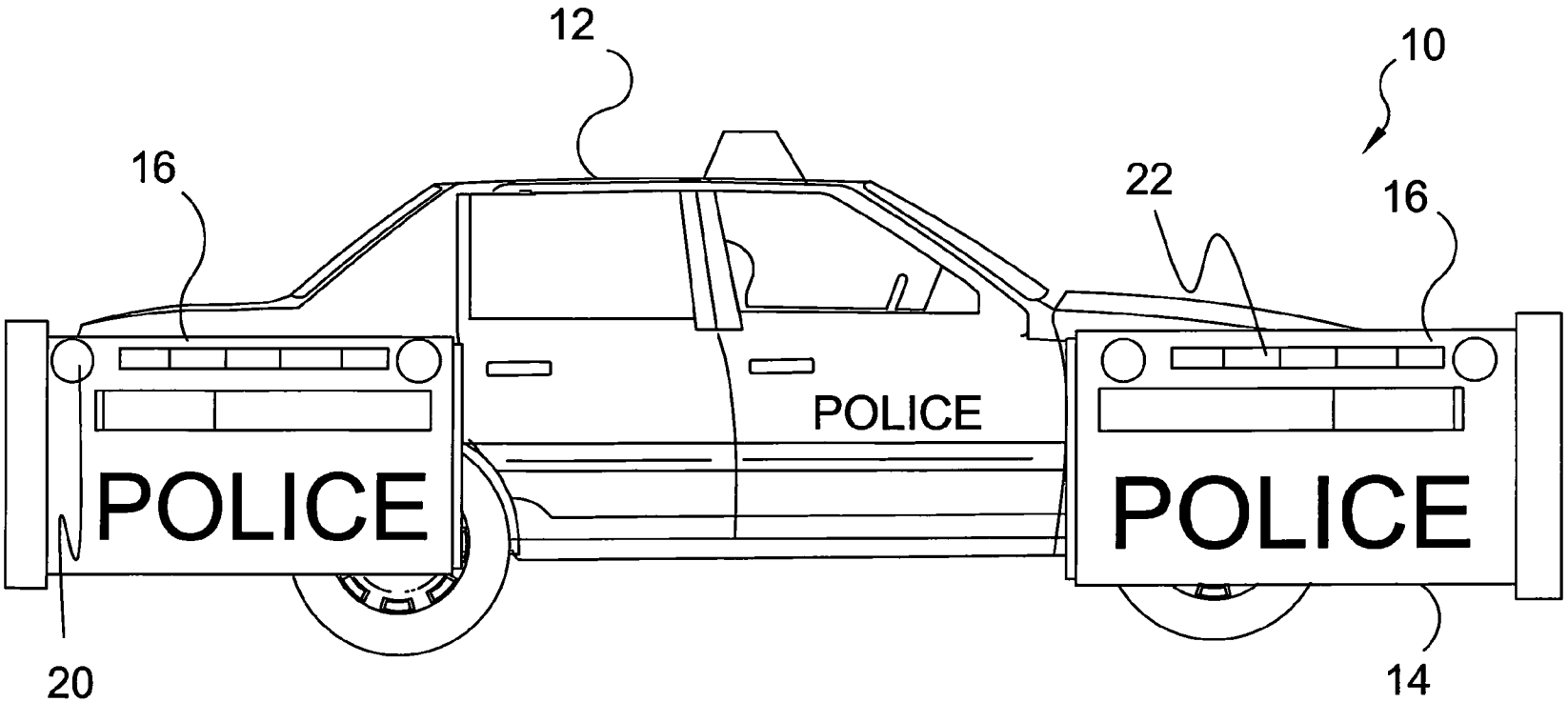
FIG. 2 is a side view of the present invention.

FIG. 2 is a side view of the present invention 10. Shown is a side view of the present invention 10 with a front defense barrier 86 and a rear defense barrier 88 mounted on a vehicle 12 in the closed position when not in use. While depicted on a police vehicle 12 the deployable shield 10 has a pivoting defense barrier 14 that will find application in any vehicle 12 requiring ballistic protection or ramming, such as military vehicles. The defense barriers 14 are hydraulically deployable from the interior of the vehicle 12 and can be deployed in whole or in part as a ballistic barrier or as a ram for disabling a target vehicle without damaging the police/military vehicle 12 having the deployable plates mounted thereon. In the closed position the defense barriers 14 also prevent gunfire or shrapnel from damaging the engine compartment and vehicle tires. The defense barrier 14 may also include flashing light strips 22 and/or halogen lights 20 on the outer surface of the armored shield 16.

Figure 3:
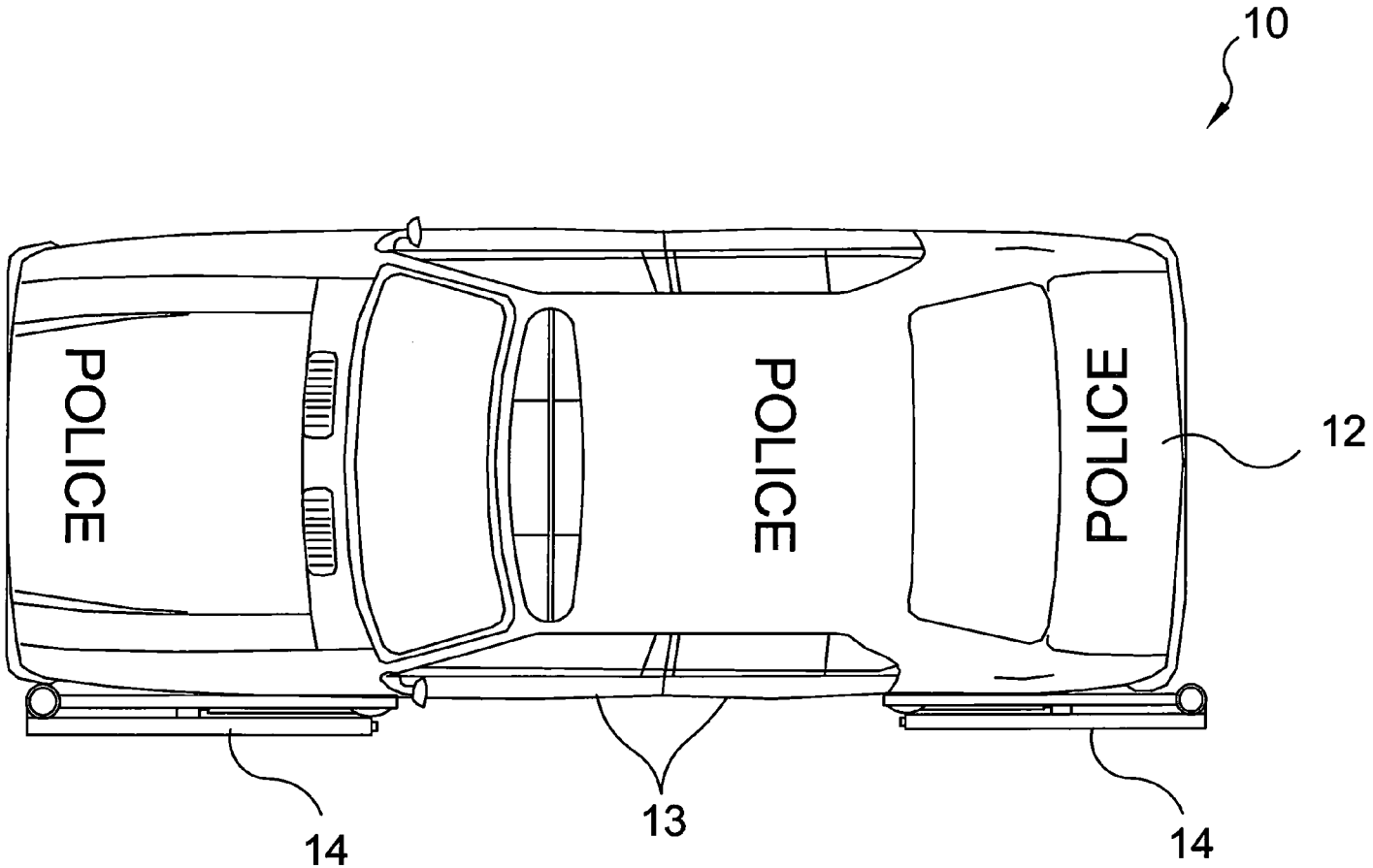
FIG. 3 is a top view of the present invention un-deployed.

FIG. 3 is a top view of the present invention 10 with the defense barrier 14 un-deployed and neatly folded against the side of a vehicle 12 so as to maintain a narrow profile and cover and protect substantially the tires and sides of said vehicle 12 from ballistic material and positioned so as not to obstruct the opening and closing of the doors 13.

Figure 4:
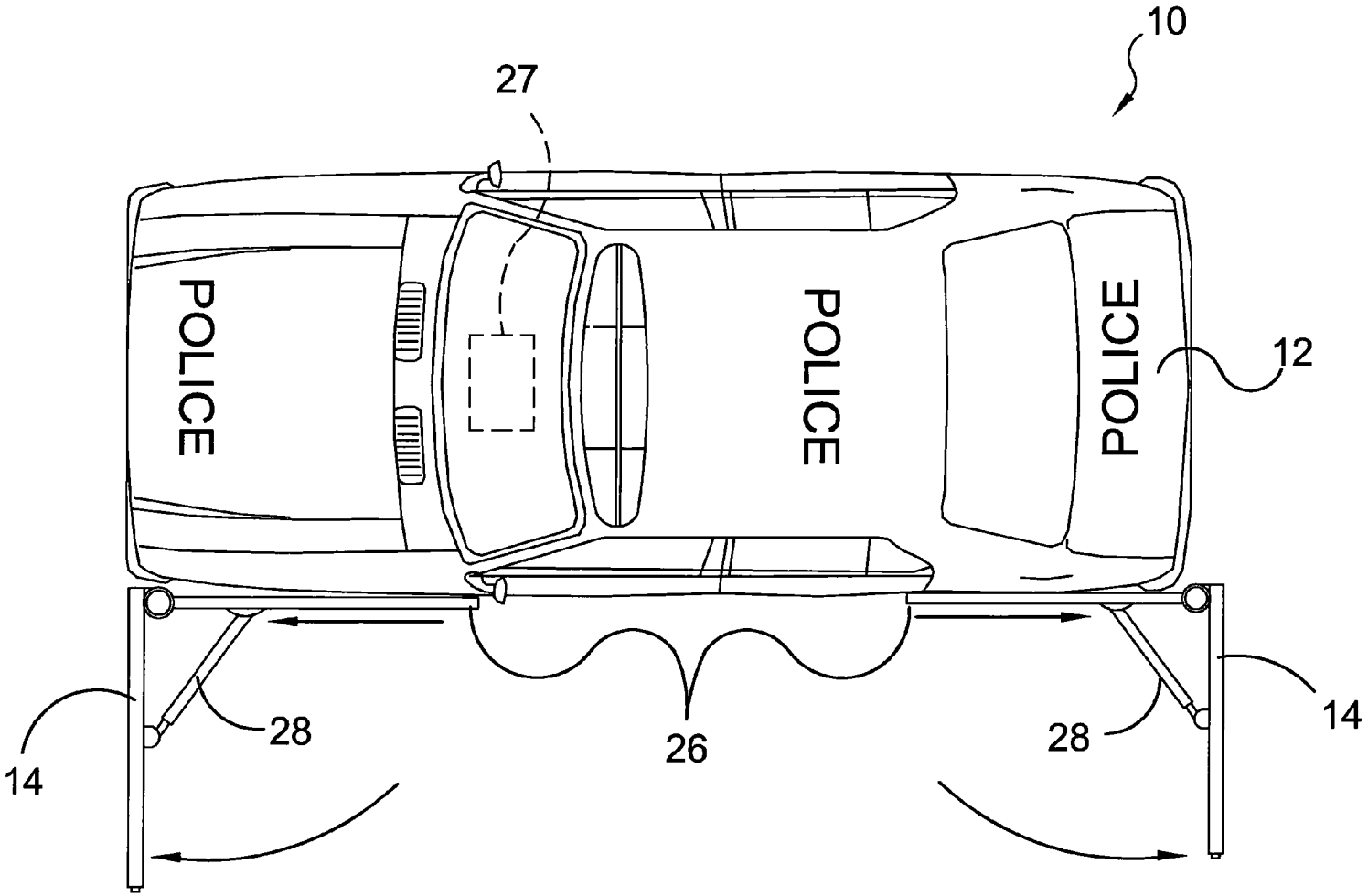
FIG. 4 is a side view of the present invention in first deployment stage.

FIG. 4 is a side view of the present invention 10 in the first deployment stage wherein the defense barrier 14 is deployed to a 90 degree angle utilizing lateral forces applied to push the hydraulic piston 28 along a slidable track 26. At the first stage of deployment the present invention 10 provides optimum strength for ramming or providing ballistic defense from large caliber/high velocity rifle fire. A user control unit 27 is provided to operate the functions of the defense barrier 14 and may be integral with the vehicle and or hand held remote units.

Figure 5:
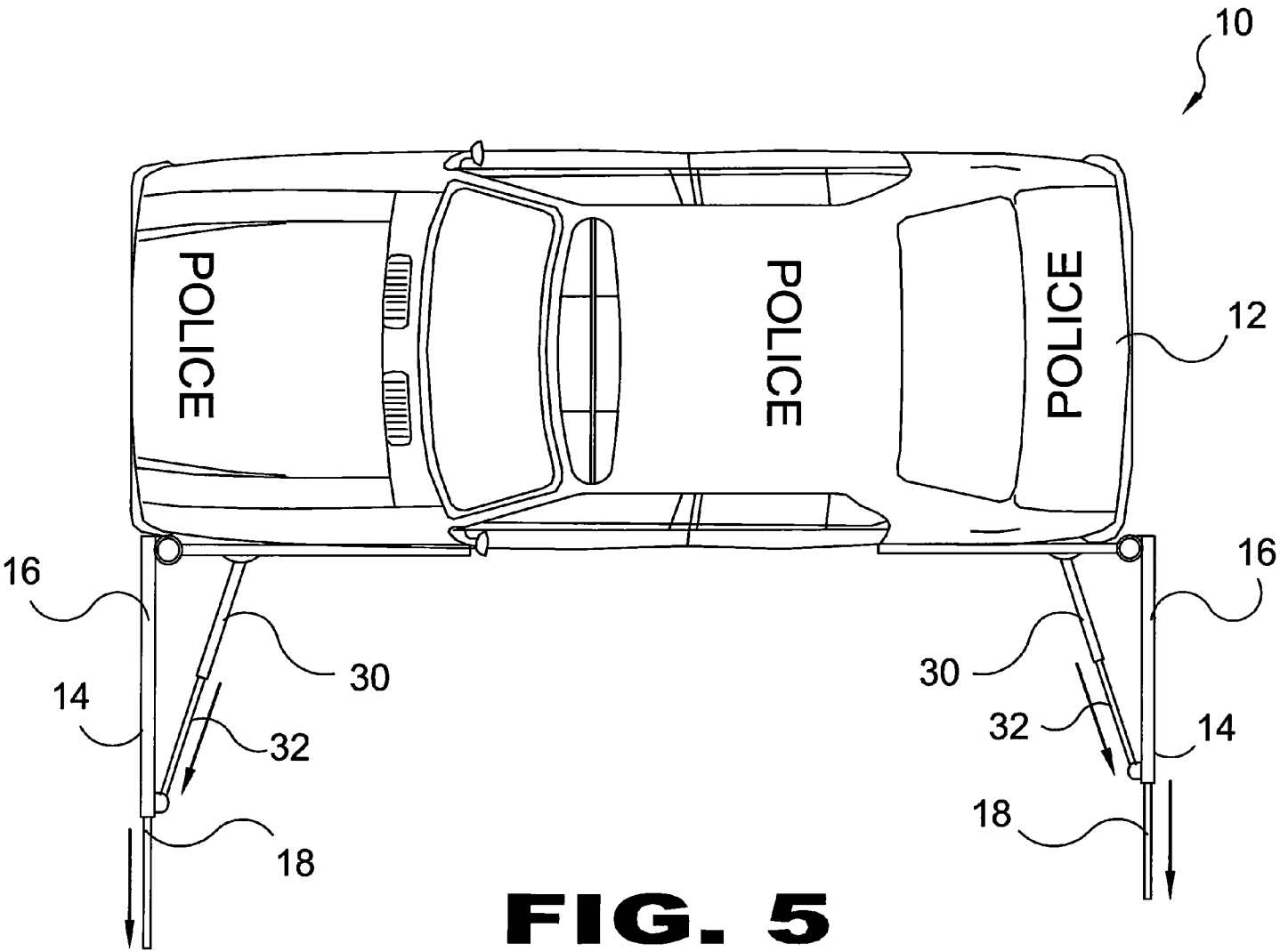
FIG. 5 is a top view of the present invention in second deployment stage.

FIG. 5 is a top view of the present invention 10 in the second deployment stage. Shown is the defense barrier 14 pivoted into position and its inner clear ballistic panel 18 extended from its housing in the armored shield 16 utilizing forces applied by the extension of the shaft 32 from hydraulic cylinder 30 to provide for a larger area of protection and defense for personnel from most small arms/pistol fire.

Figure 6:
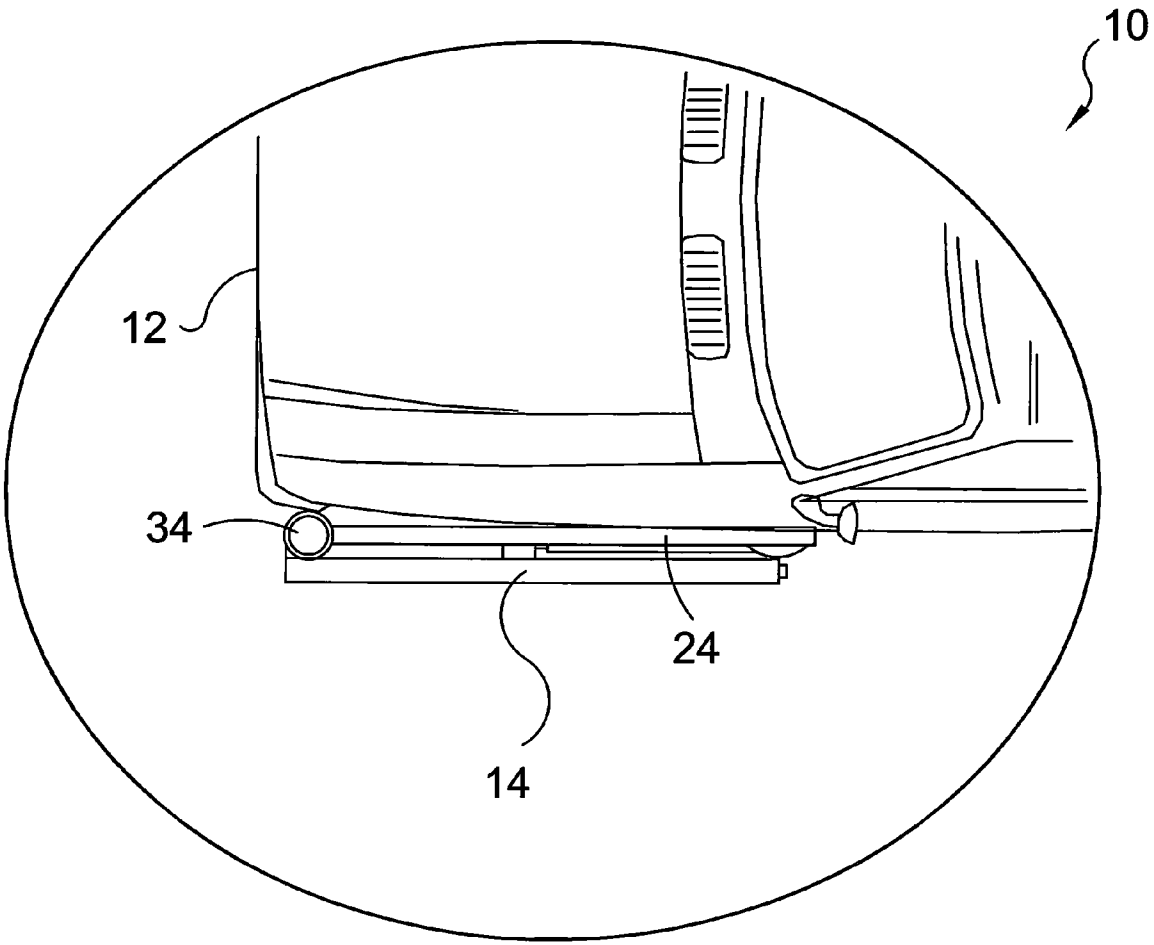
FIG. 6 is a detailed top view of the present invention undeployed.

FIG. 6 is a detailed top view of the present invention 10 un-deployed. The defense barrier 14 is neatly folded against the side of a vehicle 12 so as to maintain a narrow profile and cover and protect substantially the tires and sides of said vehicle 12 from ballistic material. Also shown is the pivot hinge 34 and its relation with the slide track mount 24 and the defense barrier 14.

Figure 7:
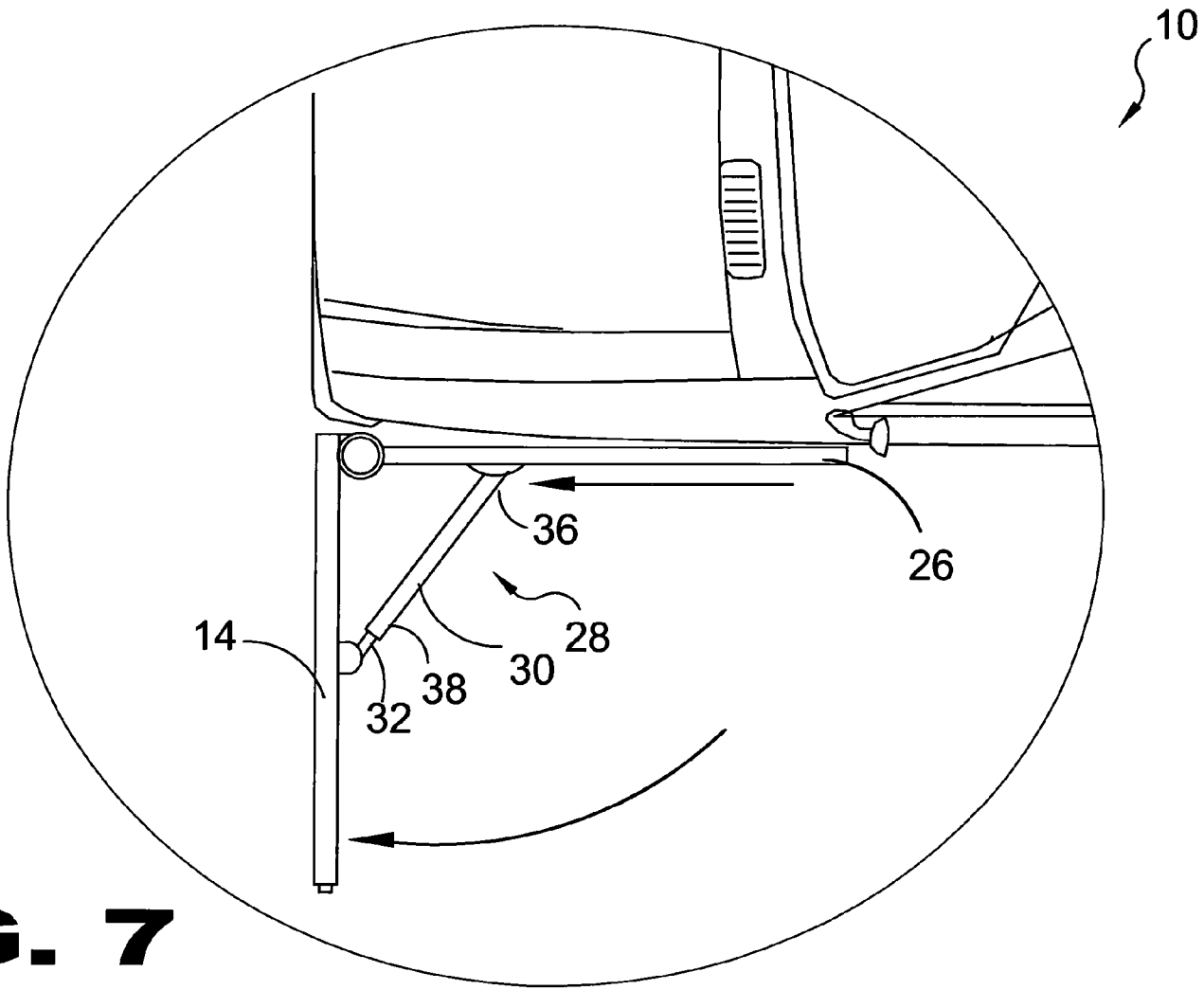
FIG. 7 is a detailed side view of the present invention in first deployment stage.

FIG. 7 is a detailed side view of the present invention 10 in first deployment stage. Shown is the hydraulic piston 28 comprising a cylinder 30 and a shaft 32 with the cylinder having a first end 36 slidably fastened to the slide track 26 and a second end 38 through which the shaft 32 extends and retracts. At the first stage of deployment the present invention 10 provides optimum strength for ramming or providing ballistic defense from large caliber/high velocity rifle fire.

Figure 8:
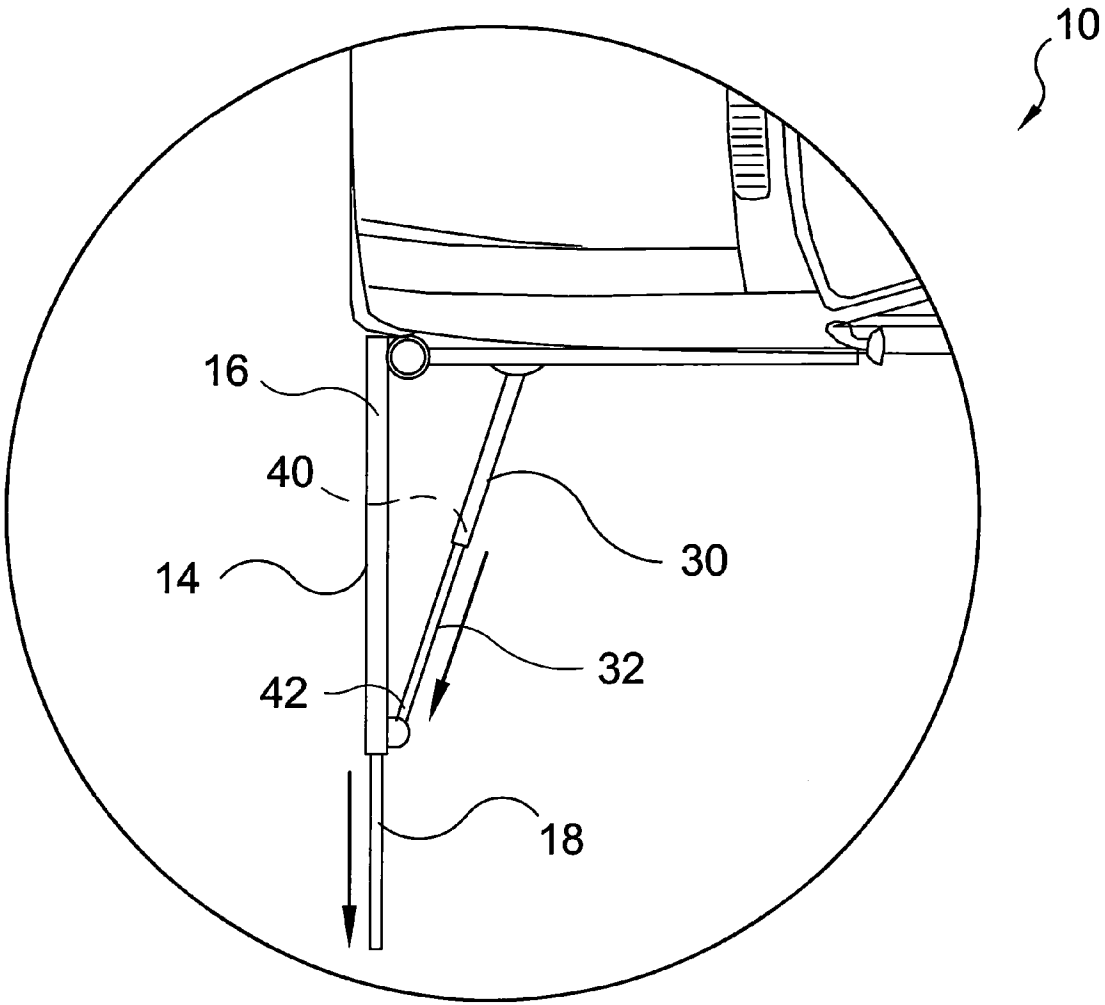
FIG. 8 is a detailed top view of the present invention in second deployment stage.

FIG. 8 is a detailed top view of the present invention 10 in second deployment stage. The defense barrier 14 is deployed and its transparent ballistic shield 18 extended from its housing within the armored shield 16 by the hydraulic piston 28 to provide for a larger area of protection and defense for personnel from most small arms/pistol fire. The piston shaft 32 has a first end 40 that is acted upon and travels within the hydraulic cylinder 30 and a second end 42 that is mounted to the transparent shield 18 wherein extension and retraction thereof is accordingly responsive to the action of the shaft 32.

Figure 9:
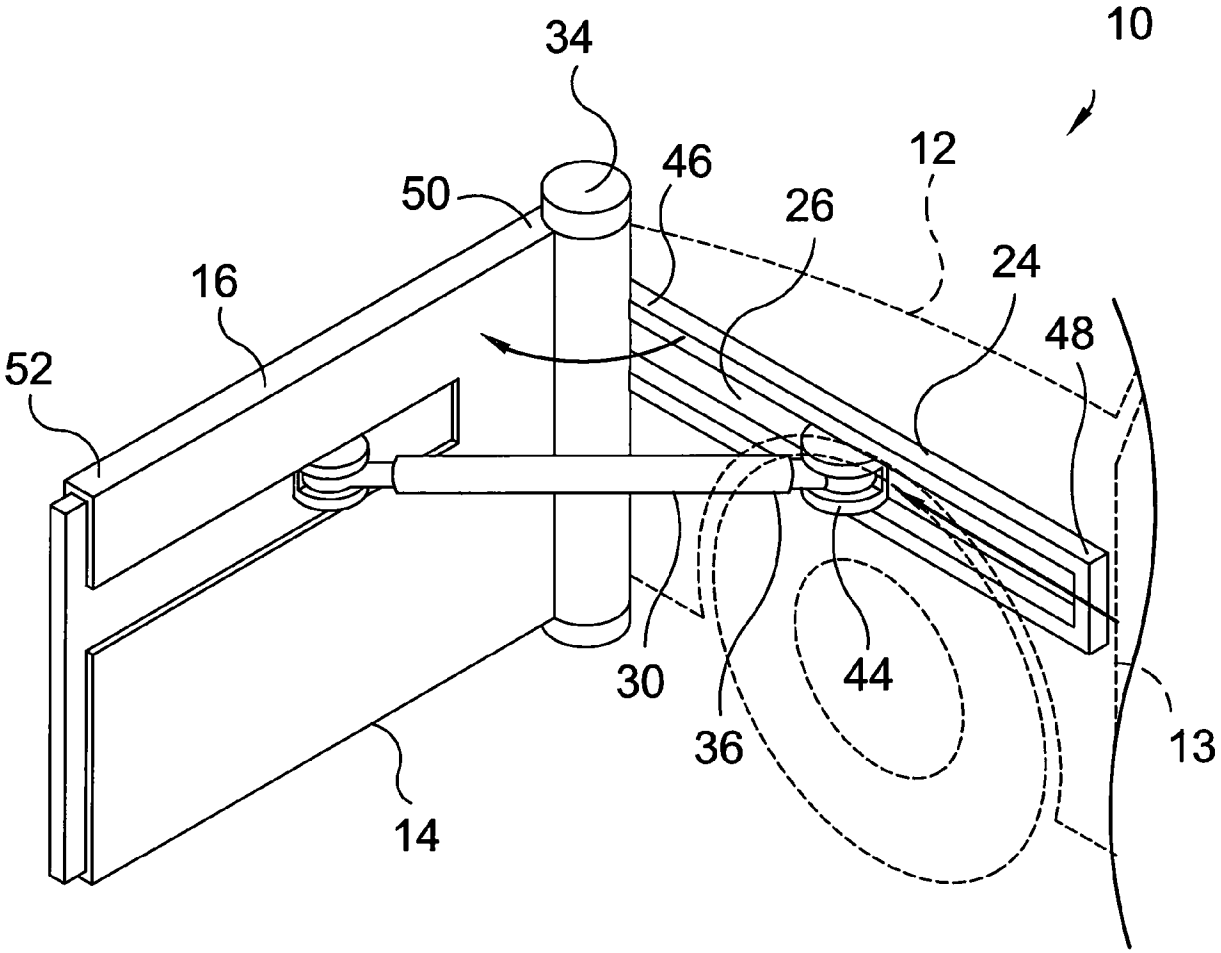
FIG. 9 is a perspective view of the present invention in first stage of deployment.

FIG. 9 is a detailed perspective view of the present invention in 10 first stage of deployment. Shown is the track mount 24 secured to the vehicle 12 and having a slidable track 26 extending longitudinally therein for receiving a pivoting cylinder slide mount 44 disposed on the first end 36 of the cylinder 30. The track mount 24 has a first end 46 disposed proximal the end of the vehicle 12 and a second end 48 that terminates prior to reaching the door in order to avoid interfering with the function thereof whether or not the defense barrier 14 is deployed. The physical pivoting connection between the track mount 24 and the defense barrier 14 is provided by the pivot hinge 34 disposed at the first end of said track mount 24. The armored shield 16 has a first end 50 pivotally engaged with the pivot hinge 34 and a distal second end 52.

Figure 10:
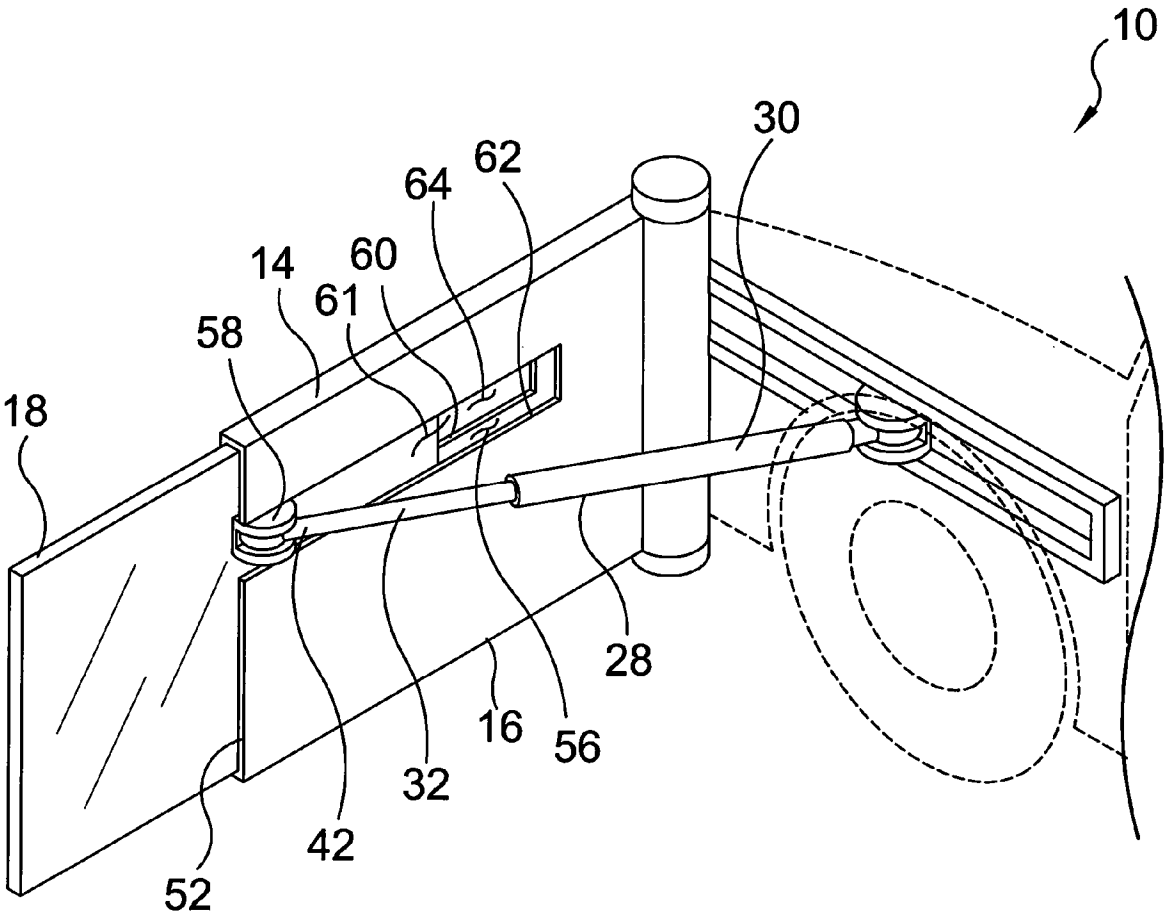
FIG. 10 is a perspective view of the present invention in second stage of deployment.

FIG. 10 is a perspective view of the present invention 10 in second stage of deployment whereby it is best suited for providing a larger field of protection to personnel from most small arms fire. The transparent ballistic shield 18 is typically composed of Lexan and is deployed outward due to force applied by the hydraulic piston 28. The armored shield 16 has a hollow interior portion defining a housing 56 in which the ballistic shield 18 resides and travels therethrough thus resulting in a front armored plate 60 and a spaced apart rear armored plate 62 with the housing 56 and ballistic shield 18 disposed therebetween. The shaft 32 is fastened to the ballistic shield 18 with a shaft pivot mount 58 disposed on the second end 42 thereof. Extension of the hydraulic shaft 32 extracts the ballistic shield 18 from its housing 56 through the open second end 52 of the armored shield 16. Corresponding slots 61 in the armored plates 60,62 form a viewing and firing port 64 to enable personnel to view through the defense barrier 14 without exposing themselves and to fire therethrough when the ballistic shield 18 is extended.

Figure 11:
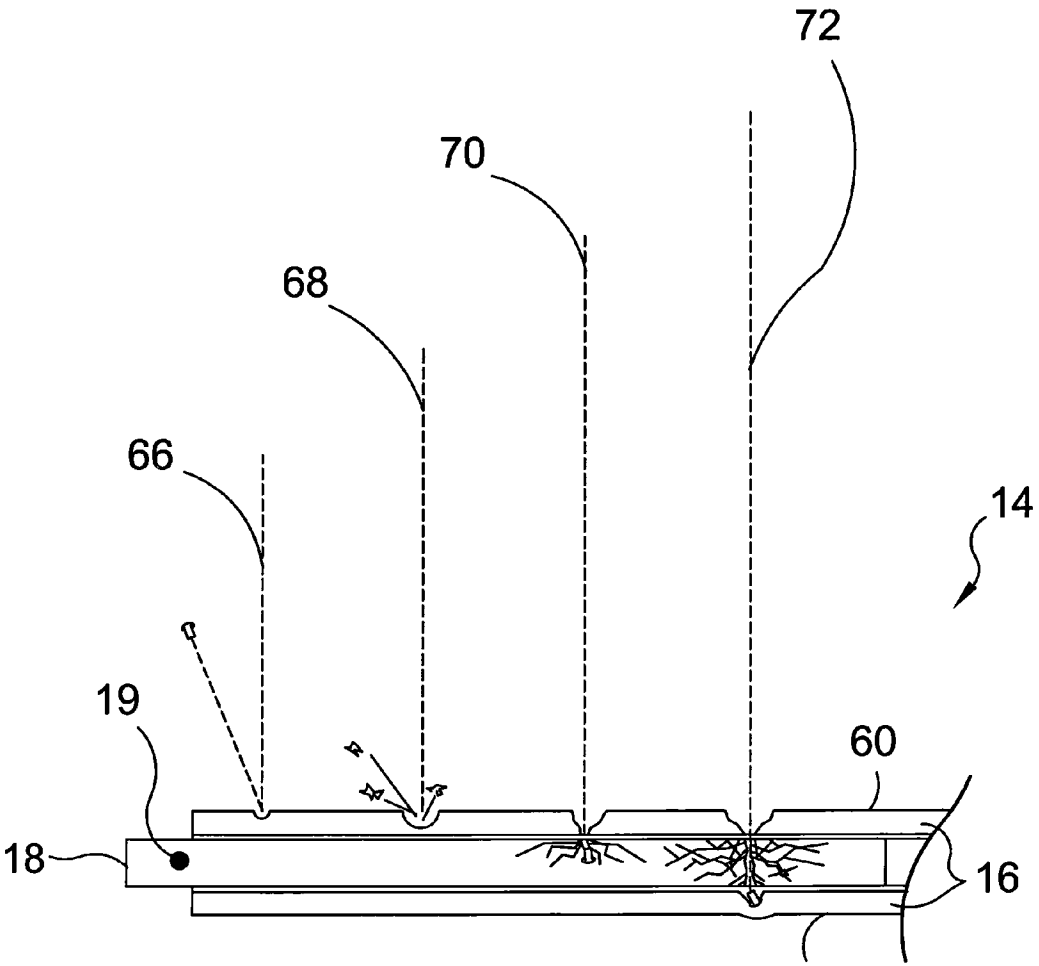
FIG. 11 is a diagram of the ballistics of the present invention.

FIG. 11 is a diagram of the ballistics of the defense barrier 14 comprising the front armored plate 60 and the rear armored plate 62 of the armored shield 16 with the ballistic shield 18 (preferably fabricated of Lexan 19) disposed therein and the defense provided from small arms pistol fire 66, magnum pistol fire 68, medium rifle fire 70 to high velocity/armor piercing rifle fire 72 in its first stage of deployment.

Figure 12:
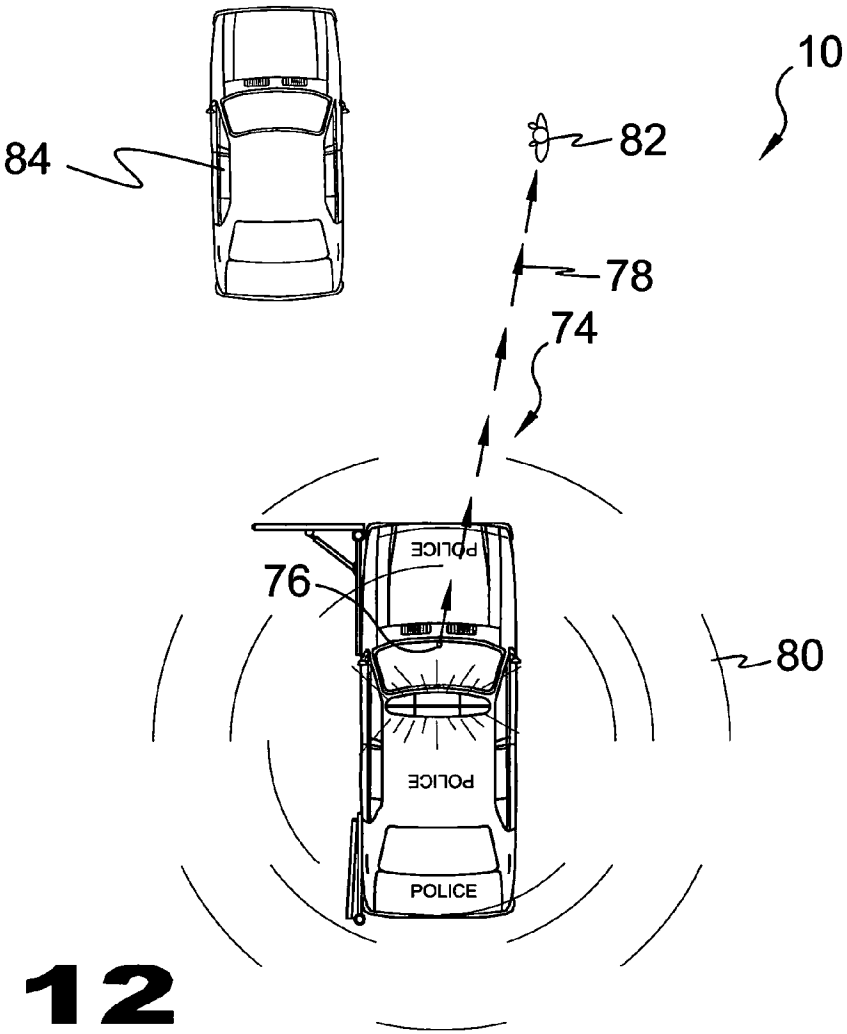
FIG. 12 is a topographic view of the present invention having radar identification and warning system.

FIG. 12 is a topographic view of the present invention 10 having radar identification and warning system 74 being used during deployment while in pursuit of a target vehicle. Shown is the present invention having radar 76 which sends out a radar sensor 78 to locate pedestrians 82 who may be entering harms way and warn them with an audible alarm 80.

Figure 13:
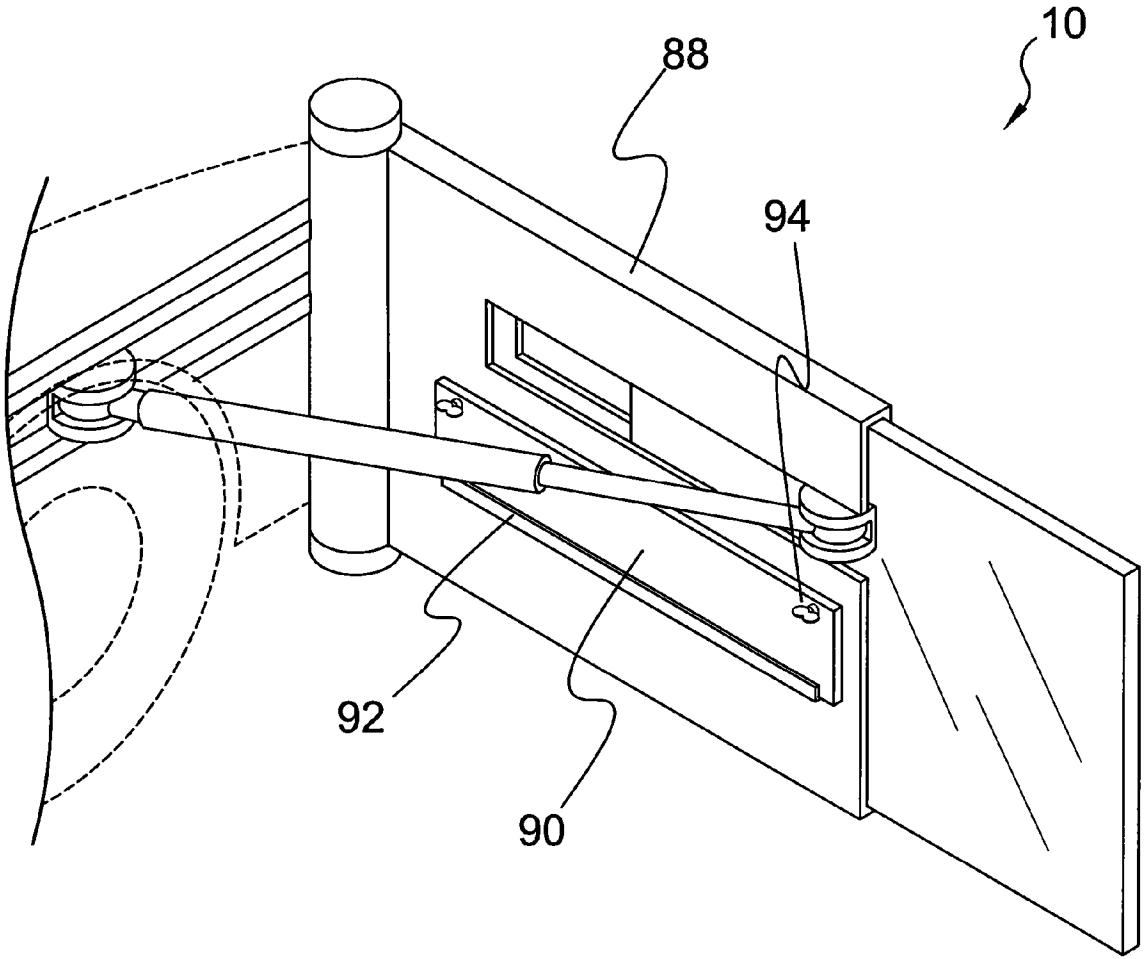
FIG. 13 is a perspective view of optional equipment of the present invention.

FIG. 13 is a perspective view of optional equipment of the present invention 10 with the rear defense barrier 88 deployed. Shown is a flip down table top 90 attached to the rear barrier of the present invention. Thumb screws secure the table top in a closed position. The thumb screws are turned to release the hingedly attached table for use.

Figure 14:
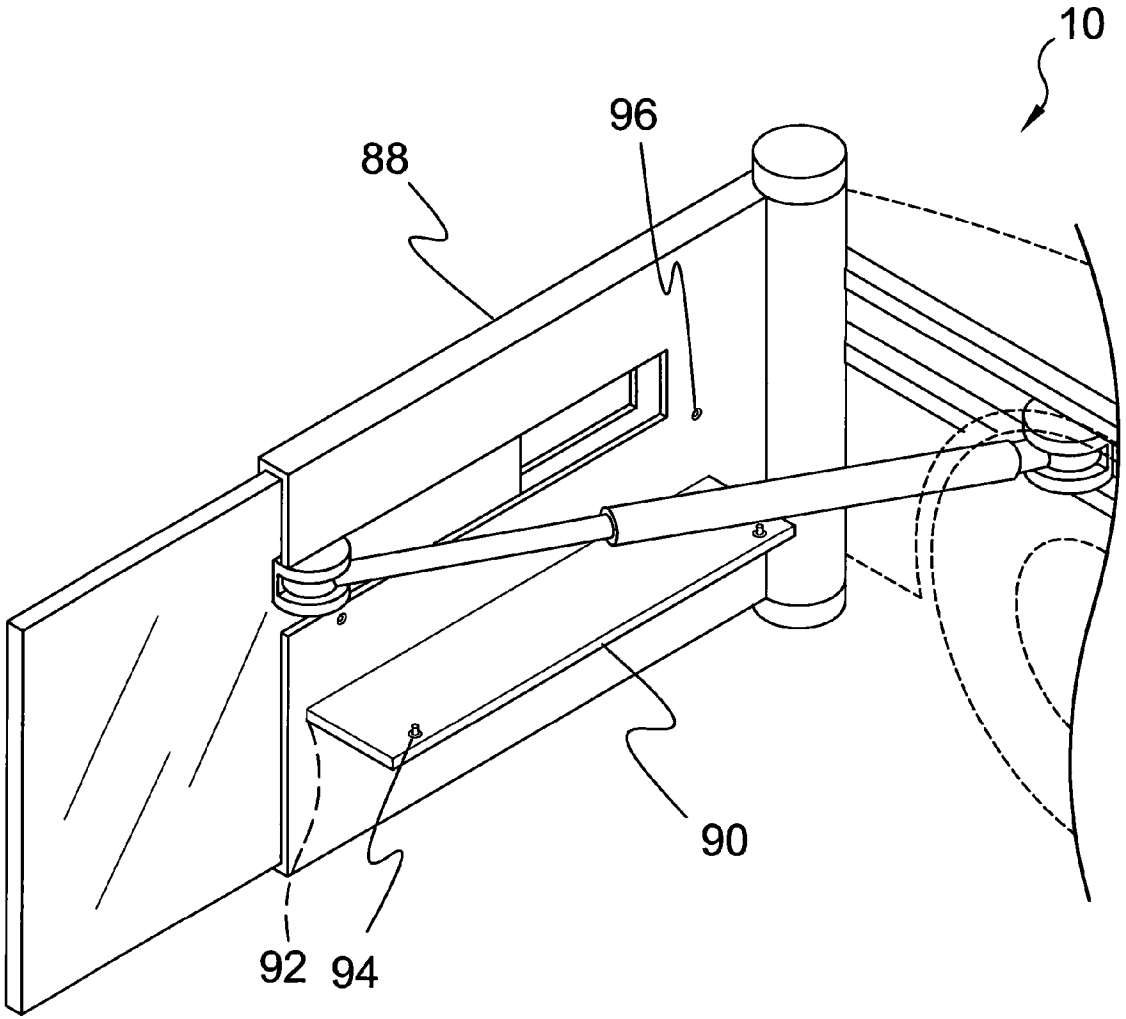
FIG. 14 is a perspective view of optional equipment of the present invention.

FIG. 14 is a perspective view of optional equipment of the present invention 10. Shown is the optional flip down table top 90 attached to the rear barrier 88 in a flipped down position. Thumb screws 94 secure the table top 90 in a closed position when secured in their respective locking ports 96. The thumb screws 94 are turned to release the hingedly 92 attached table 94 for use.

Figure 15:
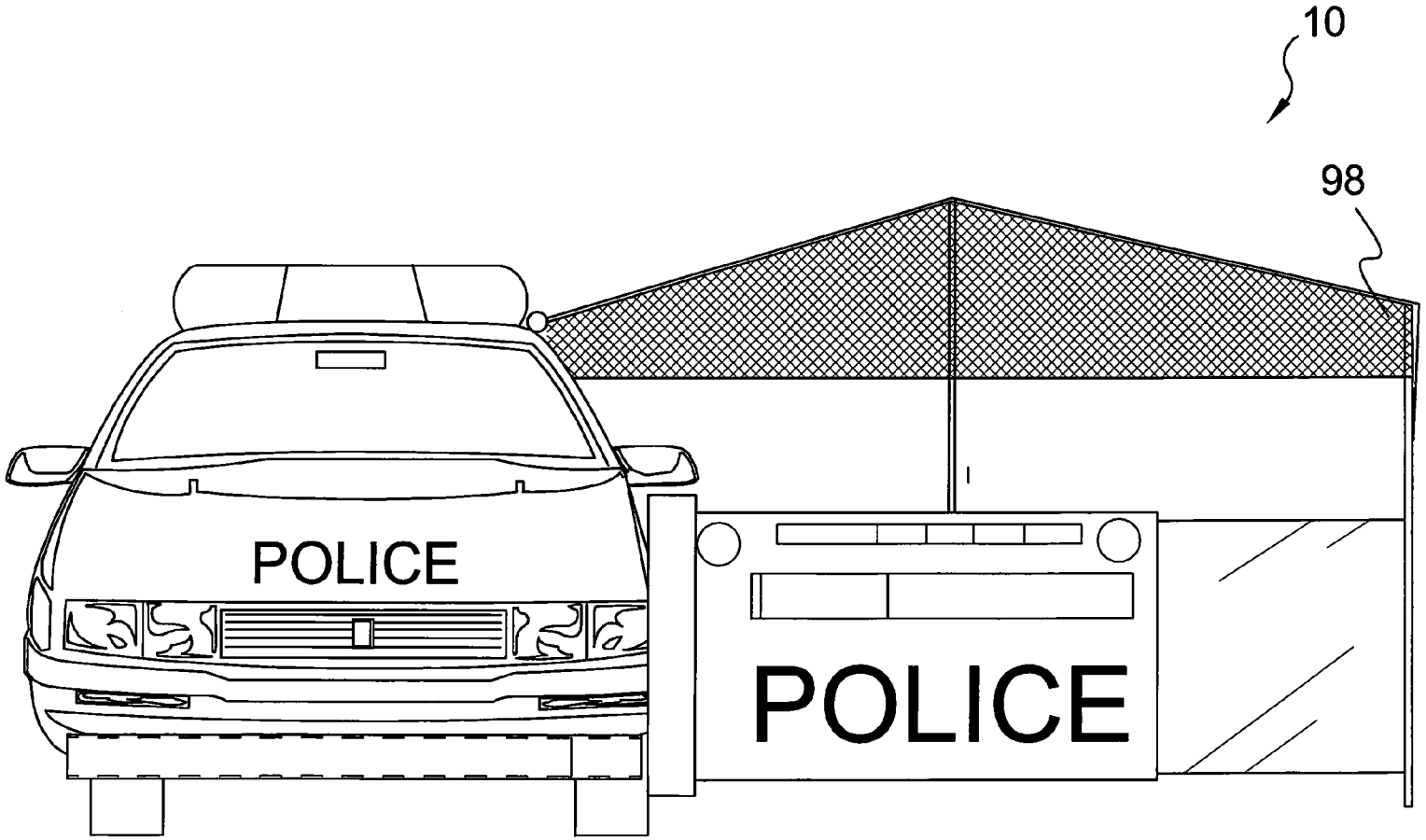
FIG. 15 a perspective view of optional equipment of the present invention.

FIG. 15 a perspective view of optional equipment of the present invention 10. Shown is the optional marquee screen 98 having a weather resistant roof and screened side walls that can be fully closed in or partially rolled up. The device protects the user from sun or inclement weather conditions.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

The invention claimed is:

1. A deployable vehicle defense shield to provide ballistic protection to a vehicle when undeployed and to exiting personnel when deployed, the deployable vehicle defense shield comprising:

a) a ballistic defense barrier having a first end and a second end, wherein said ballistic defense barrier comprises an armored shield comprised of a front armored plate and a spaced apart rear armored plate connected at the top, bottom, and first end thereof with an open second end accessing a substantially hollow interior; a transparent ballistic shield dimensioned to be slidably housed within said hollow interior of said armored shield; and corresponding slots disposed in said front armored plate and said rear armored plate to provide a viewing and firing port therein;

b) means for pivotally mounting said defense barrier to an area proximal the end of the side of said vehicle comprising a track mount secured to the side of said vehicle having a first end proximal a respective end of said vehicle and a second end terminating prior to reaching a door of said vehicle; and a pivot hinge disposed at the first end of said track mount hingedly fastened to said first end of said armored shield such that said armored shield can be pivoted to a position substantially orthogonal to the side of said vehicle; and c) a user control means for selectively pivoting said defense barrier between a substantially parallel relation with the side of said vehicle to a selected position within a 90 degree perpendicular axis therewith.

2. The deployable vehicle defense shield recited in claim 1, wherein the means for pivotally mounting said defense barrier to an area proximal the end of the side of the vehicle further comprises:

a) a slidable track disposed longitudinally within said track mount;

b) a hydraulic piston comprising:

i) a hydraulic cylinder having a first end and a second end; and ii) a shaft substantially residing within said cylinder and extendible and retractable through said second end thereof;

c) a shaft pivot mount providing a pivotable connection between a distal end of said shaft and said transparent ballistic shield through an area exposed by said slot in said rear armor plate; and d) a cylinder slide mount providing a pivotable, slidable connection between said first end of said cylinder and said slidable track.

3. The deployable vehicle defense shield recited in claim 2, wherein, when in a non-deployed position, said defense barrier is relatively parallel with the side of the vehicle, the shaft is fully retracted into the cylinder and the cylinder slide mount is proximal to said second end of said track mount.

4. The deployable vehicle defense shield recited in claim 3, wherein the user control means for selectively pivoting said defense barrier between a substantially parallel relation with the side of said vehicle to a selected position within a 90 degree perpendicular axis therewith comprises a user control unit, wherein the user control unit is energized accordingly to initiate deployment wherein said slidable track urges said cylinder slide mount towards said first end of said track mount with a resulting bias to kick out angularly and pivot said defense barrier into a selected position to achieve a first deployment stage.

5. The deployable vehicle defense shield recited in claim 4, wherein said user control unit is selectively energized when needed to initiate a second deployment stage wherein said hydraulic piston is pressurized to advance said shaft from said cylinder and extend said transparent ballistic shield from the hollow interior in said armor shield of said defense barrier.

6. The deployable vehicle defense shield recited in claim 5, wherein the defense shield is returnable to the non-deployed position.

7. The deployable vehicle defense shield recited in claim 1, wherein said transparent ballistic shield is preferably fabricated from Lexan.

8. The deployable vehicle defense shield recited in claim 1, wherein said defense barrier further comprises a flashing light strip disposed on a front portion thereof.

9. The deployable vehicle defense shield recited in claim 1, wherein said defense barrier further includes at least one halogen lamp disposed on a front portion thereof.

10. The deployable vehicle defense shield recited in claim 1, further including a radar identification and warning system for detecting pedestrians that may be in harms way and alerting them to the inherent danger.

11. The deployable vehicle defense shield recited in claim 10, wherein said radar identification and warning system comprises:

a) a radar that sends out a radar signal to detect the presence of a person within a pre-selected range once deployment has been initiated; and b) an audible alarm that is activated upon detection.

12. The deployable vehicle defense shield recited in claim 1, wherein two opposing defense barriers are provided on one side of the vehicle thus having a front defense barrier and a rear defense barrier to provide enhanced protection.

13. The deployable vehicle defense shield recited in claim 1, wherein a flip-top table shelf is provided on a rear portion of said defense barrier comprising:

a) an elongate table-top shelf plate;

b) a hinge element arranged to provide movement of said table top from an open perpendicular relation with said defense barrier to a closed coplanar relation therewith; and c) thumbscrews disposed in said table top with mating locking ports for securing said table top in the closed position.

14. The deployable vehicle defense shield recited in claim 1, further including a marquee screen having a weather resistant roof and screened side walls that can be fully closed in or partially rolled up to protect the user from sun or inclement weather conditions.

* * * * *